United States Patent [19]

Fritz

[11] Patent Number: 4,874,508

[45] Date of Patent: Oct. 17, 1989

[54] MAGNETIC SEPARATOR

[75] Inventor: Alan J. Fritz, Grand Rapids, Minn.

[73] Assignee: Magnetics North, Inc., Grand Rapids, Minn.

[21] Appl. No.: 146,039

[22] Filed: Jan. 19, 1988

[51] Int. Cl.[4] ..... B03C 1/14

[52] U.S. Cl. ..... 209/214; 209/223.1; 209/224; 209/228; 209/232

[58] Field of Search ..... 209/213, 214, 223.1, 209/224, 225, 228, 232; 210/222, 223, 695

[56] References Cited

U.S. PATENT DOCUMENTS

| | | | |
|---|---|---|---|
| 470,456 | 3/1892 | Thompson et al. . | |
| 548,176 | 10/1895 | Buchanan . | |
| 663,764 | 12/1900 | Kreuser et al. . | |
| 1,414,170 | 4/1922 | Bethke et al. . | |
| 1,459,147 | 6/1923 | Dings . | |
| 1,475,394 | 11/1923 | Jordan . | |
| 1,480,315 | 1/1924 | Thompson et al. . | |
| 2,062,545 | 1/1933 | Weis . | |
| 2,067,584 | 1/1937 | Stearns . | |
| 2,074,085 | 3/1937 | Frantz . | |
| 2,188,517 | 1/1940 | Payne . | |
| 2,733,812 | 2/1956 | Hoff . | |
| 2,808,932 | 10/1957 | Merwin et al. . | |
| 2,822,089 | 2/1958 | Woodruff . | |
| 2,826,302 | 3/1958 | Scott . | |
| 2,992,733 | 7/1961 | Buus et al. . | |
| 3,061,205 | 10/1962 | Lavallee . | |
| 3,168,464 | 2/1965 | Ferris et al. . | |
| 3,246,753 | 4/1966 | Laurila . | |
| 3,326,374 | 6/1967 | Jones | 209/214 |
| 3,375,925 | 4/1968 | Carpenter | 209/214 |
| 3,409,139 | 11/1968 | Jackson et al. . | |
| 3,487,941 | 1/1970 | Haapamaki . | |

(List continued on next page.)

FOREIGN PATENT DOCUMENTS

| | | | |
|---|---|---|---|
| 0103891 | 5/1938 | Australia . | |
| 0213174 | 1/1957 | Australia . | |
| 0429578 | 11/1972 | Australia . | |
| 0472326 | 6/1974 | Australia . | |
| 2655140 | 2/1978 | Fed. Rep. of Germany | 209/223.1 |
| 0242797 | 9/1969 | U.S.S.R. . | |
| 0588001 | 1/1978 | U.S.S.R. | 209/224 |
| 0649466 | 4/1979 | U.S.S.R. | 209/232 |
| 0766647 | 9/1980 | U.S.S.R. | 209/228 |
| 1079294 | 3/1984 | U.S.S.R. | 209/223.1 |
| 1102630 | 7/1984 | U.S.S.R. | 209/232 |
| 1318295 | 6/1987 | U.S.S.R. | 209/232 |
| 0252034 | 5/1926 | United Kingdom . | |
| 1054807 | 1/1967 | United Kingdom . | |
| 2139524 | 11/1984 | United Kingdom | 209/225 |

OTHER PUBLICATIONS

Proceedings of the High Gradient Magnetic Separation Symposium, Francis Bitter National Magnet Laboratory, Massachusetts Institute of Technology, May 22, 1973.

*Primary Examiner*—Johnny D. Cherry
*Assistant Examiner*—Edward M. Wacyra
*Attorney, Agent, or Firm*—Merchant, Gould, Smith, Edell, Welter & Schmidt

[57] ABSTRACT

An improved magnetic separator arrangement is provided. One major improvement relates to modifications facilitating utilization of relatively dense and tightly packed matrix material within races, through which a slurry of ore material passes during separation. The tightly packed matrix material is accommodated through utilization of flexible race walls, and compression and expansion mechanisms selectively operable to facilitate separation. A cover mechanism inhibits water flow turbulence, during an initial setting up of a magnetic field to entrap magnetic material within the matrix element of each race. A preferred retainer mechanism is provided which facilitates mounting of flap members for use in association with a cover mechanism, as well as retention of the matrix material in a desired position. In a preferred embodiment, the previous features are incorporated into a system fed with an ore material from an inner portion of a circular race, i.e. the center of a rotating drum.

30 Claims, 6 Drawing Sheets

U.S. PATENT DOCUMENTS 3,489,280 1/1970 Israelson et al. .
3,552,565 1/1971 Fritz .
3,567,026 3/1971 Kolm .
3,595,386 7/1971 Hradel .
3,627,678 12/1971 Marston et al. ..... 210/222 X
3,630,352 12/1971 Morse .
3,672,496 6/1972 Williams .
3,676,337 7/1972 Kolm .
3,684,090 8/1972 Kilbride .
3,690,454 9/1972 Bekhtle et al. ..... 209/214 X
3,707,229 12/1972 Holm .
3,770,629 11/1973 Nolan .
3,830,367 8/1974 Stone ..... 209/223.1
3,902,994 9/1975 Maxwell et al. ..... 209/232 X
3,920,543 11/1975 Marston et al. .
3,947,349 3/1976 Fritz ..... 209/214
3,980,562 9/1976 Nilsson ..... 209/232 X
4,046,680 9/1977 Fritz ..... 209/214
4,246,097 1/1981 Pouillon ..... 209/232 X
4,317,719 3/1982 Tokuno ..... 209/223.1

FIG. 5
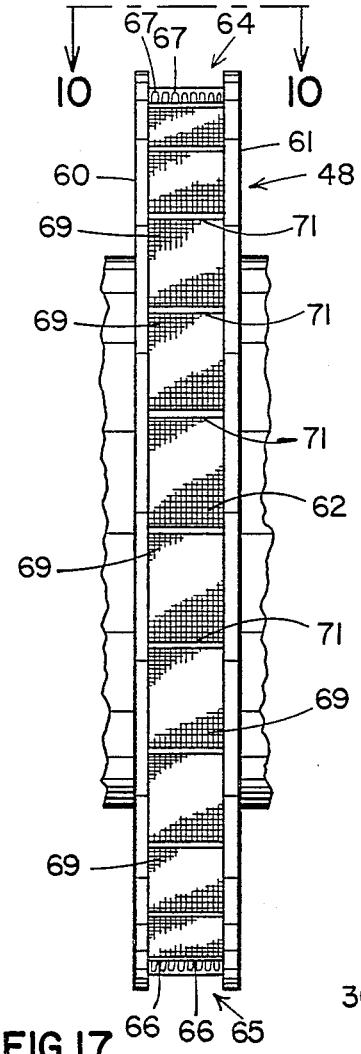
FIG. 6
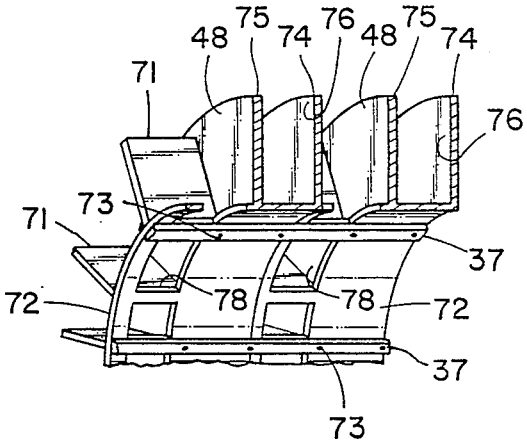
FIG. 16
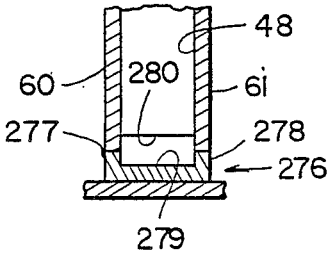
FIG. 17
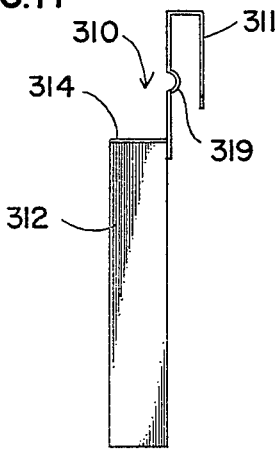
FIG. 18
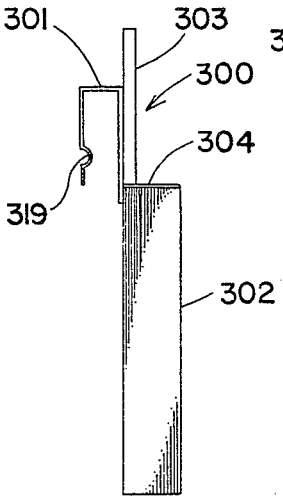
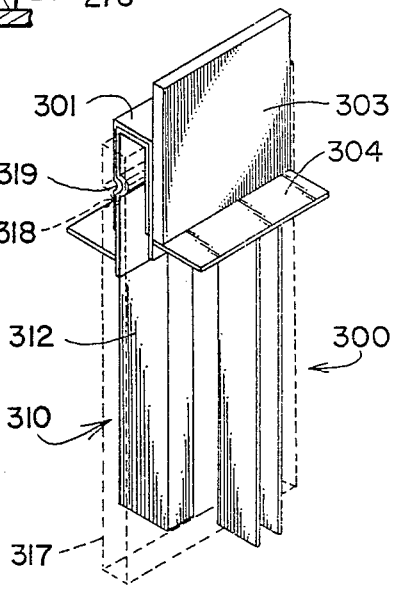
FIG. 19

FIG. 13
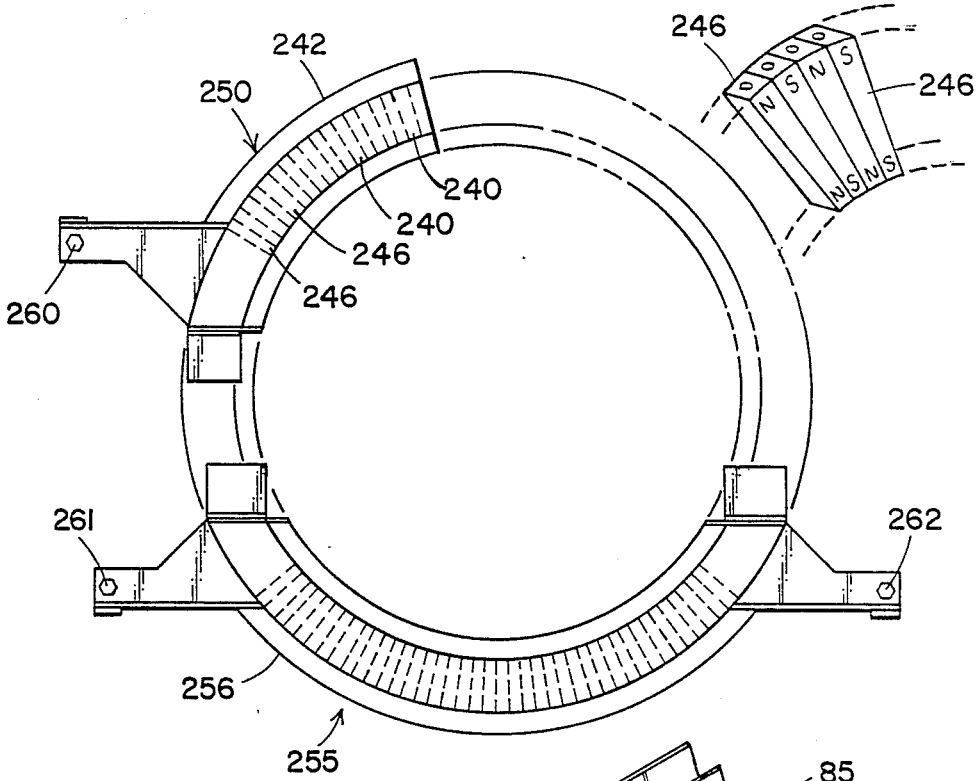
FIG. 14
FIG. 15
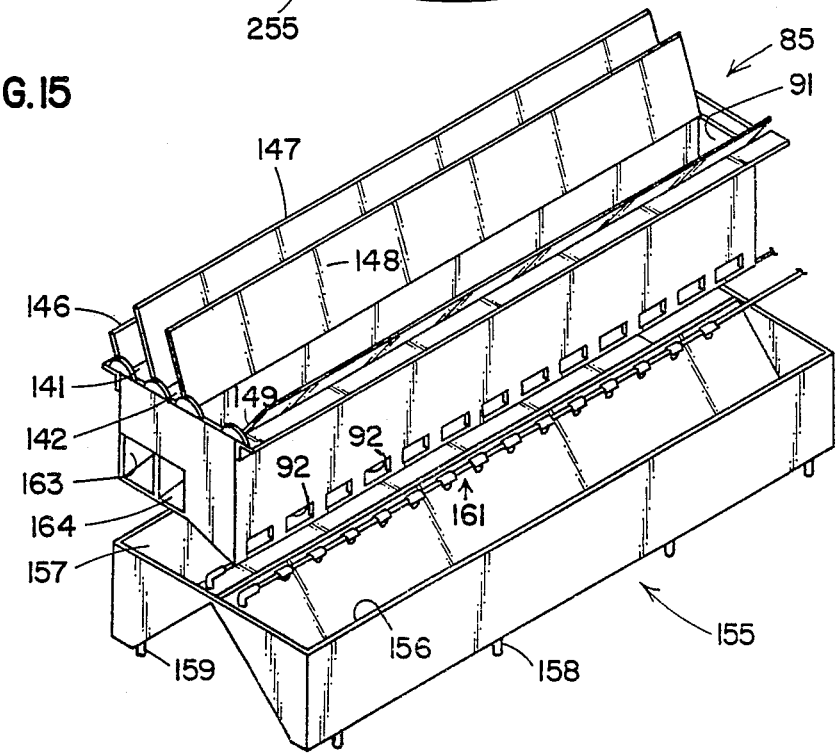

MAGNETIC SEPARATOR

FIELD OF THE INVENTION

The present invention relates and in particular to the removal of magnetic components from ores such as iron ores or the like. The invention particularly concerns high intensity separators, for efficient isolation or removal of magnetic components from ores.

BACKGROUND OF THE INVENTION

As used herein, the term "magnetic" refers to particles which are magnetically susceptible, and is not meant to necessarily imply particles which are themselves permanently magnetized. The invention concerns an apparatus for the removal of such particles from particle mixtures containing both magnetic and non-magnetic particles. Such procedures are typically used in association with iron mining operations, for example in instances in which the ore is of relatively low grade and contains much extraneous rock material, or gangue. An example of such an operation is a typical oxidized taconite mining operation, wherein the ores are relatively low grade and contain primarily weakly magnetic iron minerals as the primary magnetic component. Such ores are generally of no better quality than the discarded "tailings" of many iron mining operations, and indeed tailings from mining operations may become a valuable source of iron, due to use of a separator such as that described herein. The tailings, with magnetic materials removed, may also have commercial value.

Separation of solids according to their magnetic properties is well-known, and devices are known to perform this function. Such devices are described in detail in U.S. Pat. Nos. 3,947,349 and 4,046,680, the disclosures of which are incorporated herein by reference. Both patents issued to the inventor of the present patent, and generally concern high intensity separators. Such separators are known to perform the separation function on either wet and dry particles (slurries or powders). Further, the devices are quite effective for the recovery of weakly magnetic particles. The present invention concerns substantial improvements to such devices, yielding the advantages described herein. Generally, these relate to enablement of use of a relatively fine, high density, matrix for excellent magnetic pick up. Such a matrix could not previously be utilized as effectively, for reasons that will be apparent from the descriptions.

The conventional devices generally each comprise a large rotatable drum having a series of parallel, circular, races through which ore material to be separated is directed. Each race is generally filled with a matrix material. As the drum is rotated, the races are concurrently rotated through a 360° arc. Through a portion of the arc of rotation, the matrix material in each race is passed through an applied magnetic field. During this portion of arc movement, magnetically susceptible or magnetic materials within the ore become entrapped within the mesh. The non-magnetic materials, however, are unaffected by the magnetic field and are free to move and pass outwardly from the mesh material even within the magnetic field. The weakly magnetic materials can be released from the mesh material, after the mesh material passes beyond the applied magnetic field.

A typical operation, then, concerns appropriate direction of feed stock input into each race, relative to the applied magnetic field. Generally, the ore material is directed into the race immediately preceding, or during, rotation of the race through the applied magnetic field. Once the ore material is introduced to the race, and the race is passed into the magnetic field, the magnetic components begin to become attached to and entrapped within the mesh. Non-magnetic portions, however, pass through the mesh and outwardly from the race. Continued rotation of the race brings the mesh and entrapped magnetic material beyond the magnetic field, and the magnetic components are released from the mesh and are washed out of the race. Separate collectors can be positioned and used to receive the magnetics and non-magnetics independently. Circular construction of the individual races permits efficient operation as a continuous, rather than a batch, system. Again, this is described in detail in the '349 and '680 patents, referenced above.

While the above described systems work well in some applications, they are not completely satisfactory. Separation could be improved if finer mesh screens could be used in the races. Also, improved control of flow through the mesh would achieve improved performance.

OBJECTS OF THE INVENTION

The objects of the present invention include: to provide an improved magnetic separator or separation device; to provide such a separator particularly well-adapted for use in association with a system wherein the feed is from an internal or core portion of a drum toward an outside thereof; to provide an improved separator comprising a plurality of races, each race being separated into independent radial segments; to provide such an arrangement including a wire mesh material, positioned between race sidewalls in which magnetic materials are trapped during use; to provide such an arrangement including release means facilitating release of magnetic materials from the mesh material; to provide such an arrangement wherein the release means comprises provision of flexible materials for opposite race sidewalls, and a spreader mechanism such that, when selected, the wire mesh material is expanded to improve the release of material trapped therein; to provide an improved magnetic separator including cover means selectively inhibiting flow of water therethrough while entrapment of magnetic material within a mesh arrangement is initiated; to provide an improved magnetic separator wherein a rotatable race is separated into a plurality of independent compartments; to provide an improved magnetic separator wherein each compartment is occupied by an independent mesh segment; to provide such an arrangement wherein each independent mesh segment is mounted in a manner facilitating quick replacement while at the same time inhibiting relative lateral motion with respect to the race; to provide a preferred magnetic field orientation for such an arrangement; and, to provide such an arrangement which is relatively inexpensive to assemble and operate and which is particularly well adapted for the proposed usages thereof.

Other objects and advantages of this invention will become apparent from the following descriptions, taken in connection with the accompanying drawings, wherein are set forth by way of illustration and example certain embodiments of the present invention.

SUMMARY OF THE INVENTION

The separation device or separator described herein represents a substantial improvement over the devices of '349 and '680. As a result of the improvements, more efficient and effective separation is possible. The improvements relate to the following general features:

The devices of '349 and '680 operate with a feed through each ring-shaped vertical race being directed from the outside of the device toward the center. That is, generally, separation occurs as material is directed through the mesh from an outer periphery of the race or drum through to a center location. A problem with this is that much spillage along the outside of the drum occurs, leading to reduced efficiency and undesired mess. The preferred devices according to the present invention operate with a feed from inside the drum or an inside edge of each race, toward the outside. An understanding of this difference is fundamental to an understanding of operation of some of the specific improvements which are disclosed herein. Separation occurs, similarly as with the prior devices, while the race is rotated through a 360° arc-of-rotation by motive means.

The first major improvement concerns the nature of the mesh material utilizable in the races, for entrapment of the magnetics. Generally, the finer and/or more tightly packed the mesh material, the more efficient the entrapment of the magnetics. The problem, however, with a very fine, dense or tightly packed mesh material has been that it has been difficult to achieve efficient release of the magnetic material therefrom when desired. That is, with such a mesh material the magnetic materials become substantially entrapped in the mesh, and substantially remain there even after the race has passed beyond the applied magnetic field. Also, tightly packed mesh material in previous arrangements physically entraps tramp coarse material, not easily released therefrom.

To enhance efficient use of a relatively fine and/or tightly packed mesh, devices according to the present invention include release means, to facilitate release of the magnetics and/or tramp coarse material from the mesh material. Generally, for the preferred embodiment, the mesh material comprises a sheet of mesh which has been folded in an accordian-like, or fluted, fashion. This material is compressed tightly into the race. The release means comprises expansion means which operates to expand the folded mesh material, in a manner increasing distance between the mesh folds and enhancing release of magnetic material entrapped therein. This expansion is referred to herein as converting the mesh material from a more dense, or tightly packed, orientation to a less dense orientation. The zone over which expansion occurs is referred to as a "release zone".

For the preferred embodiment, each race has flexible sidewalls, with the mesh material extending therebetween. The expansion means includes expansion members, i.e., a cam mechanism, oriented to selectively spread at least portions of the sidewalls outwardly away from one another, at a desired location, i.e., during a portion of the rotation path over which it is desired to release the magnetic and tramp materials from the race. The accordian-like mesh material is tightly compressed between the opposite race sidewalls, and thus as the sidewalls are expanded apart the mesh material expands.

It will also be understood from the detailed description that at least sometimes when it is desired to have the magnetics be retained entrapped within the mesh material, so that substantially only the non-magnetics pass therethrough, it is preferred not to have the mesh material expanded, but rather to have same substantially compressed tightly, or in the more dense orientation. To insure that this occurs, preferred devices according to the present invention include, in association therewith, compression means to insure that the mesh material is compressed, preferably through compression of selected portions of the flexible race sidewalls, during a selected portion of the rotation path over which it is desired to have minimal release of megnetics. This is sometimes a significant feature, since otherwise a spring-like action of the tightly compressed mesh material might cause some expansion of the flexible sidewalls. For the preferred embodiment, the compression means comprises a cam mechanism composed of oppositely positioned cam surfaces or members, between which the opposite race sidewalls pass.

Preferred embodiments of the present invention are specifically adapted for use in separation of magnetic fractions from slurries of ore materials (sometimes referred to herein as ore-slurries), i.e., from suspension in water. To enhance this, each race is separated into a plurality of radially disposed compartments. As the slurry is passed through each race, intercompartmental mixing is inhibited or substantially avoided. That is, flow between adjoining compartments is minimal. This enhances the separation process, as will be understood from the detailed description. Generally, the individual compartments are formed from a plurality of spaced outwardly projecting spacer or transverse walls that extend between the race sidewalls. For the preferred embodiment, the spacer walls are positioned about 10°–20°, and preferably about 15°, apart.

For the preferred embodiment, the spacer walls are not attached to both of the opposite sidewalls between which they extend. A reason for this is that to do otherwise would, unless each spacer was expandable, generally inhibit operation of the release means to spread the race sidewalls apart. Thus, operation of the preferred release means generally involves a spreading of at least one of the race sidewalls away from the central spacer walls.

Between adjacent spacer walls a mesh-receiving compartment, or race segment, is formed. Generally, the mesh material is divided into a plurality of wedge-shaped units, each unit filling a separate race segment. Preferably, each wedge-shaped unit is mounted in a manner such that it cannot readily move independently of the race sidewalls, with respect to the spacer walls. Thus, the likelihood of the mesh material becoming pinched between the race sidewalls and the spacer walls is kept to a minimum.

Preferably, control of relative movement of the mesh material and the race sidewalls is accomplished by means of a preferred mechanism of engagement leading to relatively secure positioning of each wedge-shaped mesh extension, while at the same time permitting relatively easy removal and replacement of any selected mesh extension, as desired. A reason for this is that removal and replacement of a wedge extension, as selected, is readily facilitated. For the preferred embodiment, this mechanism of engagement involves an extension of the mesh material interlocking with a readily mountable retainer clip member.

One particular problem with previous devices concerned the initial setting up of entrapment of magnetics within the mesh, as the mesh is passed through the magnetic field. This has been a particular problem when slurries or suspension of ore material are involved. Generally, the carrier water tends to wash some of the magnetics completely through the mesh material, in spite of the applied magnetic field, before entrapment in the mesh, due to the applied magnetic field, occurs. That is, the current of the water movement operates against desired retention.

To inhibit this, when the slurry material is initially introduced into a preferred, improved device, according to the present invention, means are utilized to inhibit substantial, initial, current formation until after substantial settling of the magnetics into the mesh material. This is accomplished by means of a cover mechanism including a liner, cover trough, or cover member which generally encloses the side of the race toward which flow is directed. The liner, or cover member, prevents, at least initially, substantial water current flow through the mesh. During this portion of the rotational movement of the race, little current in the water is generated, and the magnetic materials rapidly, and efficiently, migrate through the somewhat static solution to become entrapped in the mesh. Once the race is rotated beyond engagement with the cover or liner, substantial water current is re-established, and non-magnetics are effectively carried outward from the mesh material, while the magnetics are retained therein by the applied magnetic field. The retainer clips mentioned above preferably include flap members thereon, to facilitate operation of the cover trough, as described in detail below. In particular, flap members on adjacent transverse walls define a fluid-retaining chamber therebetween, when brought into association with the cover member.

In preferred embodiments of the present invention, the 360° arc-of-rotation for each race involves passage of each wire mesh wedge or section through two sections of applied magnetic fields. For a preferred embodiment, the feed material, or slurry, is introduced into the race at a feed position oriented at the beginning of a first section or zone of applied magnetic field. Over a first segment of the first section of applied magnetic material, the cover trough or liner means operates to prevent flow of the slurry completely through the race, as the magnetics migrate to the mesh for entrapment therein. Further, the compression means preferably operates through this first zone of applied magnetic field, to enhance entrapment of magnetics in a relatively fine, tightly oriented, mesh.

After the preferred first segment of movement from the feed position and through the cover mechanism, each wire mesh segment passes outwardly from engagement with the cover member or liner means, so that a substantial current or flow through the mesh segment is established. For a next, selected, portion of rotation, each wire mesh segment is continued in passage through the first magnetic zone or area of applied magnetic field, with water flowing through the mesh to carry non-magnetics outwardly therefrom. Thus, an initial, rough, separation of non-magnetics from magnetics is achieved.

In a second portion of rotation another section or zone of magnetic field is applied in preferred embodiments, again retaining the magnetics in position. Preferably a backwash of water is applied to the mesh segments in this section of magnetic field, to facilitate further removal of the non-magnetics from the magnetics.

After passing outwardly from the second applied magnetic field, each wire mesh segment rotates into association with the release means, i.e., through a release zone, whereby the relatively tightly compressed mesh segments are spread open. At this point a second backwash is preferably applied, this time to wash the magnetic components outwardly from the mesh. It will be understood that the initial rough non-magnetic tailings, the non-magnetics from the second wash, and the magnetics from the release segment, can be collected separately and treated as desired. Further, the initial rough tailings may themselves be originally collected in different fractions, to advantage.

For conventional devices such as those described in '349 and '680, magnetic fields are applied across each race, i.e. between the race side walls, such that for each race a constant, relatively unchanging, magnetic field is encountered during rotation. More specifically, for the conventional arrangements the magnets are aligned such that north constantly occurs to one side of a given race, with south constantly occurring on the other.

In preferred embodiments according to the present invention, each magnetic zone comprises a plurality of alternating magnetic fields. That is, for example, each mesh segment through its rotation may first encounter a section of magnetic field aligned in one direction, and then a section of magnetic field aligned in the opposite direction, etc. This arrangement is not only relatively easy to construct, but it appears to facilitate the overall separation process.

For the preferred embodiment, the applied magnetic fields are adjustable in strength, in order to accomplish a variety of desired, selected, arrangements. In particular, for the preferred embodiment the magnets are mounted on adjustable carriers or arms, for movement relative to the race sidewalls, to adjust the effective strength of the magnetic fields with respect to the races.

In preferred embodiments of the present invention, each race is ring-like in construction, with the mesh material entrapped between opposite, deformable, generally planar sidewalls. The race(s) is oriented vertically for rotation about a generally horizontal axis; i.e., with the sidewalls in substantially vertical planes. Herein, the topmost, or highest, point of rotation of the race is referred to as the uppermost point, or 0° point. Generally, ore-slurry feed is into an inside edge at a point along an arc extending between points 90° and 270° from the 0° point, in the direction of rotation. A reason for this is so that ore-slurry feed is directed, initially, by gravity into the race. More preferably, the feed is between the 120° and 180° points, and most preferably it is at about 135° from the uppermost point.

Preferably the first magnetic zone is oriented along a path or arc extending between the feed point and the 270° position, so that non-trapped material is driven by gravity through the mesh material toward, and outwardly from, the race outer edge. More preferably, the first magnetic zone extends from the feed point to approximately the 240° position. Beyond this position, the outer edge of the race is rotated high enough not to allow much likelihood of flow outwardly therefrom.

The release zone is generally oriented after the first magnetic zone, and preferably along the upper arc-of-rotation, i.e., between the 270° point and the 90° point. In this manner, release of entrapped magnetics occurs such that gravity tends to drive the material toward the inner edge of the race. Preferably the release zone extends between the 345° point and the 30° point.

In preferred embodiments, a second magnetic zone is provided between the first magnetic zone and the release zone. Preferably, the second magnetic zone extends between the 270° position and the 90° position, and most preferably it extends between the 300° position and the 345° position.

The drawings constitute a part of this specification, and include exemplary embodiments of the present invention while illustrating various objects and features thereof. It will be understood that in some instances relative component sizes, and material thicknesses, may be shown exaggerated to facilitate an understanding of the present invention.

BRIEF DESCRIPTION OF THE DRAWINGS

FIG. 5 is an enlarged fragmentary side elevational view of a portion of a component of the device depicted in FIGS. 2, 3 and 4.

FIG. 6 is a fragmentary, perspective view of a component of the device depicted in FIG. 2.

FIG. 13 is an enlarged fragmentary, partially schematic, view of a portion of an apparatus according to the present invention.

FIG. 14 is an enlarged fragmentary partially schematic view of a portion of the device depicted in FIG. 12.

FIG. 15 is an enlarged fragmentary depiction of a portion of the apparatus illustrated in FIGS. 2, 3 and 4.

FIG. 16 is an enlarged, fragmentary cross sectional view of a portion of the apparatus shown in FIG. 12, generally from the perspective of line 16—16.

FIG. 17 is an enlarged side elevational view of a component of the device shown in FIG. 2.

FIG. 18 is an enlarged side elevational view of a component of the device shown in FIG. 2.

FIG. 19 is an enlarged perspective view showing operation of the components depicted in FIGS. 17 and 18.

DETAILED DESCRIPTION OF PREFERRED AND ALTERNATE EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but rather as a basis for the claims and as a representative basis for teaching one skilled in the art to variously employ the present invention virtually any appropriately detailed structure.

Figure 1:
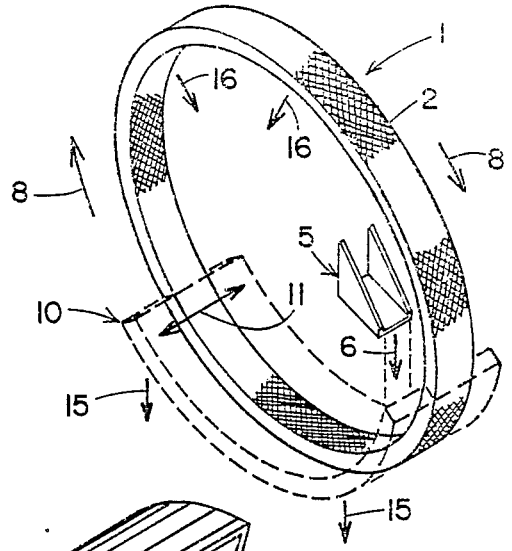
FIG. 1 is a schematic illustrating general principles underlying operation of a separator device according to the present invention.

In FIG. 1 there is shown a schematic representation illustrating the principles of general operation of a device according to the present invention. Referring to FIG. 1, reference numeral 1 generally designates a foraminous body or race. The body 1 as illustrated forms a circular, ring-shaped, structure 2. By "foraminous" it is meant that structure 2 comprises a porous mesh material, or the like, through which ore material to be separated is passed.

At reference numeral 5 a feed mechanism is depicted, directing ore material along path 6 into foraminous structure 2, with concurrent rotation of foraminous structure 2 in the general direction of arrows 8, i.e. clockwise for the arrangement shown. As structure 2 is rotated, feed material enters along the path 6, and the material eventually filters through the foraminous structure 2, with some passing outwardly along an opposite side thereof.

Reference numeral 10 generally indicates a zone in which a magnetic field is selectively provided. Preferably, the magnetic field is generally aligned across or at right angles to the path of the rotating race 1, i.e. normal to the path of arrows 8, and with the magnetic field generally aligned in the directions indicated by double headed arrow 11.

During passage through magnetic field 10, magnetic components in the ore feed become entrained or entrapped within the foraminous structure 2. Non-magnetic materials, on the other hand, can pass through the tortuous paths of foraminous structure 2, and outwardly along a lower side thereof. Thus, for example, non-magnetic material for the arrangement shown in FIG. 1, would be deposited along the general path of arrows 15 while magnetic material, at least within zone 10, would be retained within the structure 2.

However, once the structure 2 has been rotated so that the magnetic material has passed outwardly from magnetic zone 10, no magnetic force is present to hold the magnetic material within the structure 2, and the magnetic material can be dropped from within the structure 2, for example along the paths indicated by arrows 16. For the embodiment shown in FIG. 1, magnetic material drops toward a center of circular structure 2, due to gravity.

The above general principles of operation are similar to those utilized by the devices shown in United U.S. Pat. Nos. 3,947,349 and 4,046,680, both issued to the inventor of the present invention. One major difference between the arrangement disclosed in those patents and the device disclosed herein, is that for the arrangement depicted in FIG. 1, feed is generally from inside the circular structure 2, toward the outside, whereas for the arrangements of '349 and '680 feed was generally from outside of the ring inwardly. It will be understood, however, that in general the overall principles are the same.

For most applications, the foraminous structure 2 comprises a matrix made from a steel or the like, generally not itself magnetic, folded into a fluted structure, thereby providing for a plurality of tortuous paths to material passing therethrough. In some instances even magnetic material may be utilized, for certain types of separation. Generally, the finer, denser or more tightly packed the matrix, the better or more improved the retention of magnetic material since more surface area of mexh is provided in the immediate vicinity of particles to be entrapped. However, it will be understood that, generally, if the matrix is too tightly packed, or is of too great a density, without the improvements of the present invention release of magnetic material from within the matrix, when desired, for example at 16 in FIG. 1, may be difficult to achieve.

Figure 2:
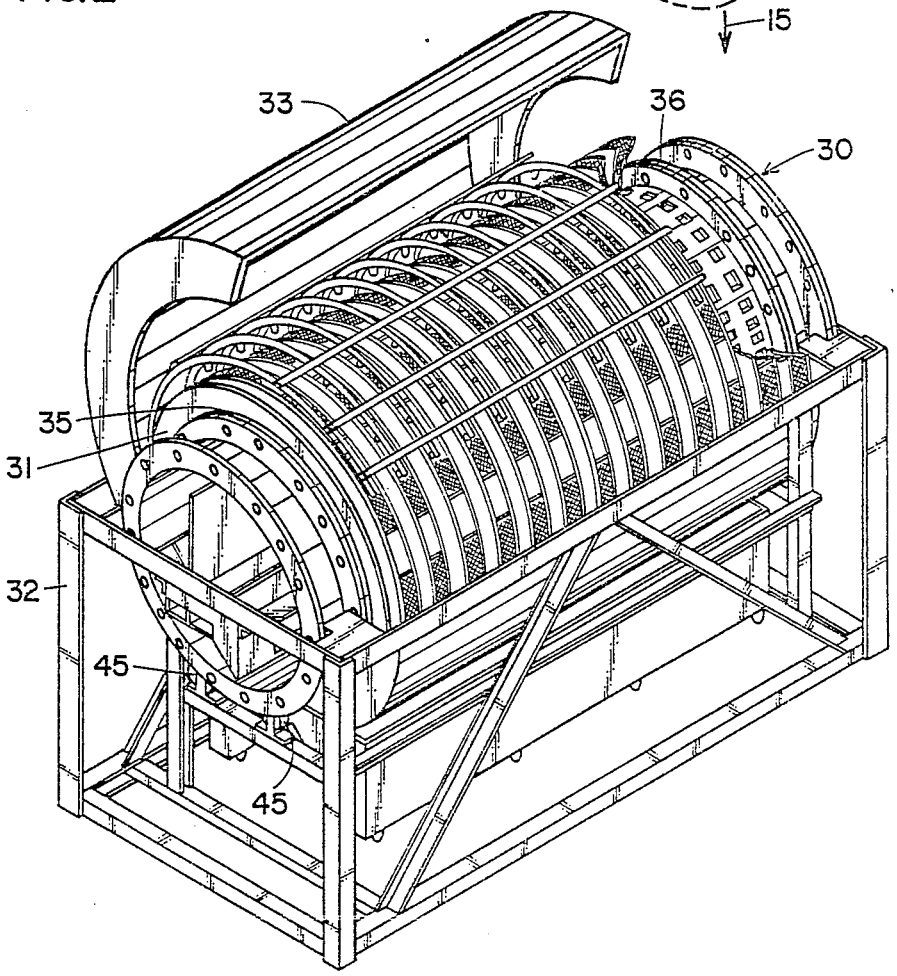
FIG. 2 is a partially schematic, perspective view of an improved device according to the present invention, with portions broken away to show internal detail.
Figure 3:
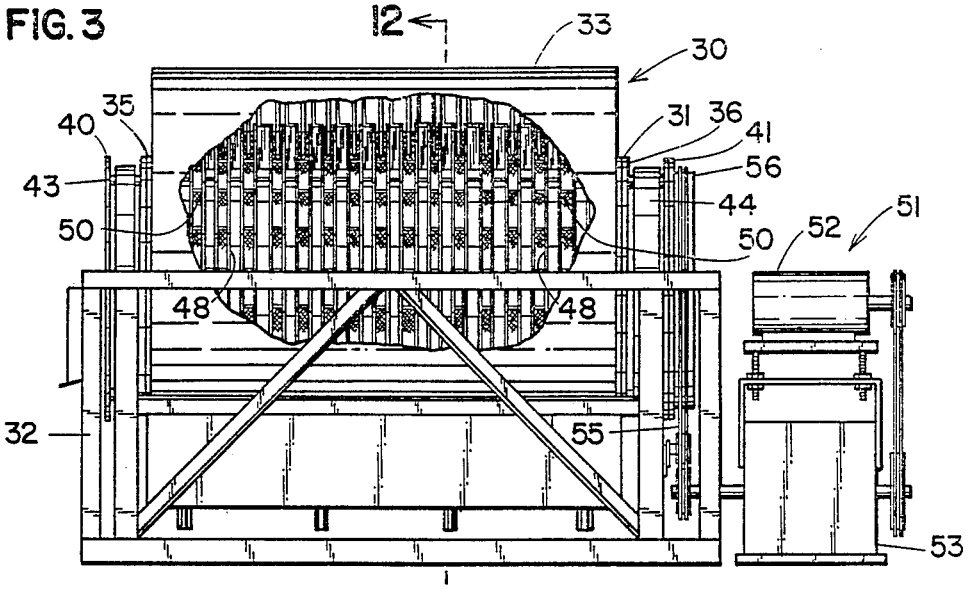
FIG. 3 is a side elevational view of a device according to FIG. 2, with portions broken away to generally show internal detail, with a splash guard in a lowered position, and with a power or motor mechanism depicted.
Figure 4:
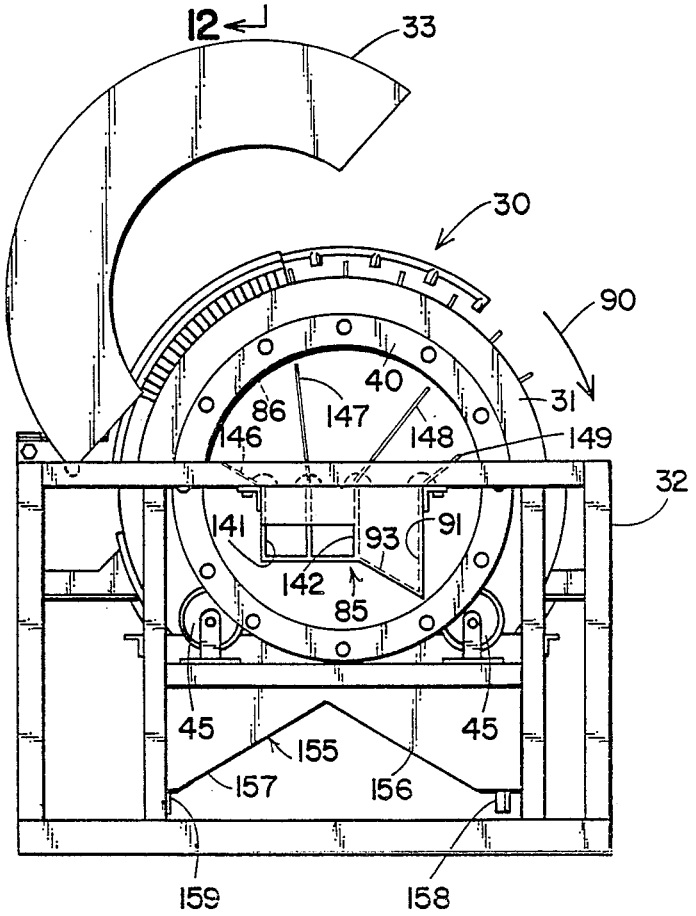
FIG. 4 is a side elevational view of the device shown in FIGS. 2 and 3, with phantom lines showing internal detail.

The general features of a devices according to the present invention will be understood from reference to FIGS. 2, 3 and 4. Referring to FIG. 2, a separator device 30 is depicted, the device having been improved by means and mechanisms according to the present invention. Device 30 generally comprises a drum 31 rotatably mounted in frame 32. It will be understood that a variety of sizes of drums 31 and frames 32 may be utilized for devices according to the present invention. For a typical operation, drum 31 has an outside diameter of about 4–5 feet and an inside diameter of about 2½–3½feet.

Device 30, for the embodiment depicted in FIG. 2, is provided with a splash cover or member 33, which can be lowered about a hinge point to partially encircle the drum 31. The preferred drum 31 comprises a pair of circular, ring-shaped, bearing plate structures 35 and 36, between which a plurality of spaced ribs 37, FIG. 16, extend.

The drum 31, FIG. 3, includes end plate structures 40 and 41, spaced from bearing plate structures 35 and 36, respectively, by bearing races 43 and 44 respectively. The frame 32 includes mounted therein a plurality of bearings or rollers, for example rollers 45, FIGS. 2 and 4, oriented to engage races 43 and 44, to rotatably support drum 31.

Drum 31 includes mounted thereon a plurality of laterally spaced filter races 48, FIG. 3. It is noted that in FIG. 3, the device 30 is depicted with the splash guard 33 lowered. The filter races 48 each carry therein a matrix structure which performs the general function of structure 2, FIG. 1. For the embodiment of FIGS. 2, 3 and 4, the drum 31 carries a plurality of such filter races 48, longitudinally spaced with respect to one another. Thus, feed can be made into, and filtering can be accomplished by, a plurality of simultaneously operating filter races 48.

In FIG. 3 device 30 is depicted in side elevation, with each of the spaced filter races 48 being readily viewable, each packed with matrix element or structure 50. A single race is depicted in FIG. 5, discussed below.

Referring further to FIG. 3, motive means comprising motor or motive mechanism 51 is depicted. While a variety of arrangements may be utilized to power drum 31, for the preferred embodiment described and shown, the motive mechanism 51 comprises a motor 52 and gear box 53 operable to drive drum 31, and the corresponding races 48, by means of a belt 55 engaging pulley 56 in a more or less conventional manner, about a substantially horizontal axis-of-rotation.

Detail concerning the individual filter races will be understood by reference to FIG. 5. Referring to FIG. 5, a side elevational view of one of the races 48 is shown. Race 48 includes first and second circular, ring-shaped, opposite, substantially planar, sidewalls 60 and 61, spaced apart from one another and having matrix material 62 positioned therebetween. For the preferred embodiment, matrix material 62 comprises a folded, fluted portion of stainless steel matrix material, which is itself relatively non-magnetic. However, it will be understood that a variety of materials may be utilized for matrix element 62. From viewing of the top 64 and bottom 65 portions of the race 48 depicted, the manner in which the matrix element 62 is folded and pressed between the side walls 60 and 61 will be understood. Generally, matrix element 62 is oriented in a manner providing a plurality of concentric troughs 66 and ridges 67.

For the preferred embodiment, the matrix element 62 is separated into a plurality of independent segments 69. Preferably each segment 69 is the same size; although they do not appear as such in FIG. 5 because of the curved structure being represented as a two-dimensional projection. Referring to FIG. 5, spacing between mesh segments 69 is accomplished by means of a plurality of spacer or transverse walls 71 which extend between sidewalls 60 and 61. Each spacer wall 71 inhibits lateral fluid flow communication between adjacent segments 69. Advantages obtained from this will be understood from the further detailed description. Generally, each spacer wall 71 comprises a fin or a paddle extending radially through the race 48. While a variety of numbers of segments may be utilized, generally, for preferred embodiments, spacer walls 71 will be positioned radially between about 10° and 20° apart, and preferably about 15° apart, around the entire race 48.

Further details concerning the construction of the races 48 will be understood by reference to FIG. 6, wherein a fragmentary perspective view of a portion of two races 48, without matrix material therein, is presented. Each race or ring 48 comprises: a cylindrical band 72 secured to ribs 37 of drum 31, as by screws 73; and, a pair of outwardly extending flanges 74 and 75; the former (flange 74) joining the band 72 along one edge and the latter (flange 75) extending outwardly from the band 72 part way across its width. Space 76 between flanges 74 and 75 accomodates a magnet system, as described below. The matrix element sections, see FIG. 5, are contained in spaces or races 48 between flange 74 and the central flange 75 of the mounting ring or cylindrical band next adjacent. The bands 72 are each perforated through that portion of their circumference which is within the race 48, by apertures 78; the apertures permitting water and/or ore material to pass through the races 48. Spacer walls 71 are mounted on band 72, and preferably join flange 75.

Each race 48 is mounted on the drum 31 in such a manner that the races 48 rotate concurrently with the drum 31, when powered by the mechanism 51. A variety of rotation speeds may be utilized in devices according to the present invention, preferred rates being about 5-6 revolutions per minute, such speeds enabling both efficient and effective operation.

Figure 12:
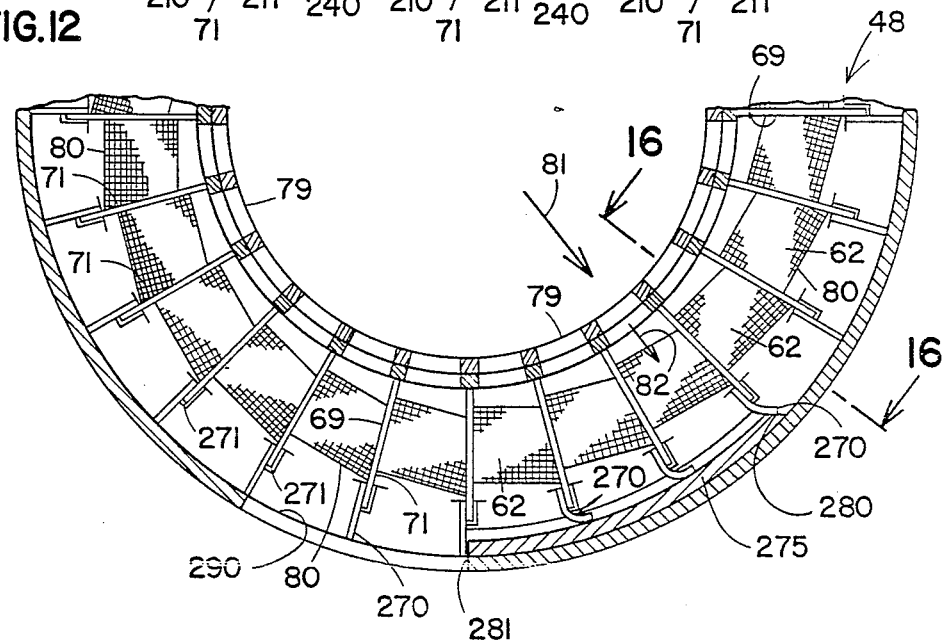
FIG. 12 is an enlarged cross-sectional view of a portion of the device taken generally from the orientation of line 12—12, FIG. 3.

As suggested above, and indicated by FIG. 1, generally feed into each race 48 is along an inner annular surface or edge 79, FIG. 12, so that initially the material flows generally toward the outer circumferential area or edge of each race 48. In FIG. 12, a cross-sectional view of the drum 31 is depicted, taken generally along the line 12—12 of FIG. 3. A race 48 is viewable, divided into segments 69, by walls 71. Each segment 69 is partially filled with matrix material 62. For the preferred embodiment depicted, the matrix material 62 is formed into a plurality of wedge shaped sections 80, one per segment 69. Feed of ore material to be treated is generally along the path indicated by arrow 81, i.e. onto the inner portion or edge 79 of the race 48. As a result, initial flow of material in each section 80, is along the general path indicated by arrow 82.

Referring to FIGS. 4 and 15, generally a feed hopper and collection system 85 is positioned in an interior 86 of the drum 31. System 85 does not rotate with the drum 31, rather the drum 31 rotates therearound and with respect thereto. For the preferred embodiment described and shown, referring to FIG. 4, generally rotation of the drum is in the direction indicated by arrow 90, and feed of the material to be processed occurs from feed hopper 91, via ports 92, FIG. 15.

Referring to FIG. 15, system 85 includes a hopper 91 with a plurality of feed ports 92, spaced from one another and oriented to direct feed into each of a plurality of spaced races 48, FIG. 3. Referring to FIG. 4, generally hopper 91 includes a slanted lower wall 93, appropriately oriented to direct feed flow toward apertures 92, and outwardly from hopper 91 into a feed point for each race.

A variety of means, not shown, may be utilized to initially deposit feed material into hopper 91. For example, a conduit arrangement, not shown, may be provided.

The present invention is particularly well-adapted for use in association with the refinement of slurries of ore material, typically containing between about 10–40%, by weight, solids. Such materials can be about readily pumped and directed into and through hopper 91.

Figure 7:
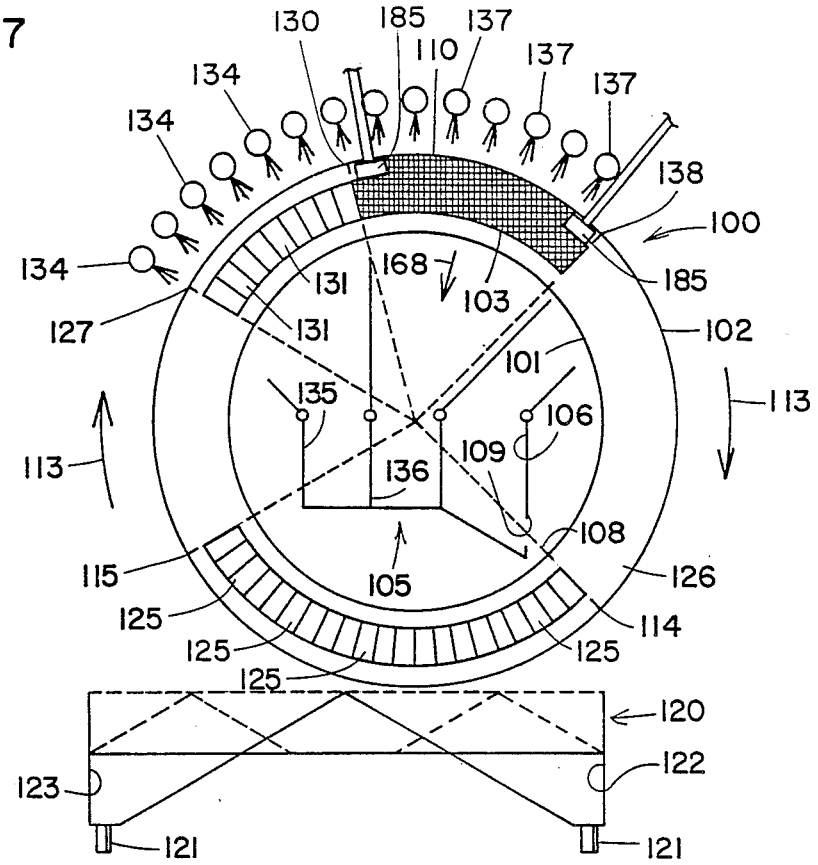
FIG. 7 is a schematic depicting a device according to the present invention from the general orientation indicated by FIG. 4.

Before further detail concerning FIGS. 4 and 15 is provided, attention is directed to FIG. 7 wherein a schematic representation of a device according to the present invention is provided. Generally, in FIG. 7 a circular filter race 100, generally analogous to any of races 48, is schematically depicted. Race 100 includes an inner annular surface or edge 101 and an outer annular surface or edge 102. Race 100 will be understood to be packed with matrix material, such as material depicted at 103.

For the embodiment shown in FIG. 7, a feed hopper and collection system 105, generally analogous to system 85, is shown directing slurry to be treated via hopper 106 into race 100 at point 108, i.e. through port 109. For the arrangement depicted, point 108 is oriented about 135°, in a first direction of rotation, from the very top or uppermost point of race 100, depicted at point 110.

During operation, race 100 is rotated, in the general direction indicated by arrows 113.

While receiving feed from port 109, race 100 is rotated through a magnetic zone or magnetic field indicated between the points designated by reference numerals 114 and 115. During this arc of transport or rotation, magnetic material within the feed generally becomes entrained within matrix material 103, and does not pass freely through race 100. Non-magnetic materials, on the other hand, carried by the carrier water, can flush through the system and into trough system 120, drain therefrom being provided by drains 21. Thus, through at least a portion of the arcuate segment indicated between points 114 and 115, an initial rough separation occurs, with magnetic material being retained within the matrix 103. In FIG. 7, trough system 120 is depicted separated into sections 122 and 123, to provide a rough separation of non-magnetics into separate streams flowing toward opposite drains 121. Should larger or smaller, or more or less pure, fractions of non-magnetics come out at different points, such a multi-trough section arrangement can provide an advantageous separation.

Referring again to FIG. 7, the magnetic field between points 114 and 115 is generated by a plurality of magnets 125 mounted along a side 126 of race 100. It will be understood the magnets 125 are fixed relative to motion of the race 100, and do not rotate therewith. Further detail concerning mounting of magnets 125 will be understood by further detailed description given below with respect to FIGS. 11, 14 and 15. The magnets are positioned in spaces 76 between walls or flanges 74 and 75 of each band 72, FIG. 6.

Referring again to FIG. 7, after passing outwardly from the magnetic field defined between points 114 and 115, segments of race 100 are rotated through an arcuate path defined between points 115 and 127. During this portion of the arcuate motion, relatively little, if any, separation of any type occurs. It will be recalled that for the preferred embodiment, FIG. 12, each race 48 is divided into a plurality of segments, by internal walls 71. One advantage to this is that during motion through the arcuate segment defined between points 115 and 127, fluid flow communication or mixing between adjacent chambers is avoided. That is, rotational speed is generally slow enough to prevent the ore material from being spun outwardly from the race 100; and, the internal walls 71 prevent the ore material from passing downwardly to the next following segment on the same race 48.

Following motion past point 127, each segment passes through the arcuate segment defined between point 127 and point 130. During this region a second magnetic zone or field, provided by magnets 131 is provided across the race 100. Magnetic material within the matrix element 103 again becomes entrapped. A backwash provided by sprayers 134 further washes entrapped magnetic material substantially free of non-magnetics. The non-magnetic tailings generally flow to the interior of the drum, to be collected in a collection hopper, indicated at reference numeral 135. An advantage to an arrangement utilizing this second magnetic field is an increase in efficiency of operation; and, further, a provision of a magnetic fraction of enhanced purity.

After passing point 130, segments of rotating race 100 pass outwardly from the applied magnetic fields. As a result, the entrapped magnetic fraction is released from the matrix arrangement, to fall into the interior of the drum, preferably for collection in hopper 136. To facilitate washing of material from the matrix 103 into hopper 136 sprayers 137 are provided. Generally as race segments pass point 138, they are relatively clean due to the backwash of sprayers 137, and the race segments continue to point 114, whereat they receive further feed from hopper 106.

A variety of sizes of arcuate segments may be chosen for arrangements according to the present invention. For the preferred embodiment depicted in FIG. 7: the segment extending between points 114 and 115 is about 105° of arc; the segment between points 115 and 127 equals about 60°; the arc between points 127 and 130 equals about 45°; and the arc between points 130 and 138 equals about 45°. A variety of sizes of arcs may be utilized, however, the above merely providing an example. The overall efficiency of the system will, in part, be dependent on the sizes of arcs chosen and the amount of backwash used. Preferred ranges were discussed above, in the Summary of the Invention.

From the above description of the schematic illustration in FIG. 7, the embodiment depicted in Figs. 4 and 15 will be readily understood. Generally, assembly 85 includes feed hopper 91 and first and second collection hoppers 141 and 142, analogous to hoppers 135 and 136 shown in FIG. 7. In particular, backwash from the second magnetic field, and containing non-magnetic materials, is collected in hopper 141; whereas backwash containing the magnetics is collected in hopper 142. Divider walls 146, 147, 148 and 149, respectively, help divide and direct flow from the races into appropriate hoppers. Preferably, dividers 146, 147, 148 and 149 are hingedly attached to system 85, and can be locked into various, selected, angular positions, as desired.

System 85 also includes a bottom trough system 155 oriented underneath the hoppers 91, 141 and 142. Trough system 155 operates analogously to trough system 120, FIG. 6. That is, the initial flow of non-magnetics, in the first magnetic section, is into troughs 156 and 157 and outwardly through drains 158 and 159. Sprayers 161 are oriented, and selectively actuatable, to help clean out trough system 155 of any sludge material entrapped therein.

Generally system 85 extends within the drum longitudinally throughout an entire extent therein, and each of collection troughs 141 and 142 has a bottom wall slanting downwardly toward outlets 163 and 164, FIG. 15, to facilitate flow of collected material outwardly from the entire device 30. This flow may be facilitated by streams of water provided via sprayers, not shown.

Up to this point the device 30 is generally analogous to those devices described in U.S. Pat. Nos. 3,947,349 and 4,046,680 except for the following features: (a) the provision of means enabling feed from the inside; and (b) the utilization of more than one applied magnetic field, to facilitate the separation process. Detailed figures showing construction of certain analogous features may be found in those references.

Other significant manners in which the device according to the present invention distinguishes the '349 and '680 references will be apparent from the following descriptions.

It is preferred to utilize a very fine, relatively dense, matrix material packed relatively tightly. A problem with such materials, especially when packed tightly, is that once magnetic ore components become entrapped therein, they can be quite difficult to remove therefrom. This is the case even when a backwash such as described above is used.

However, a tightly packed, and relatively dense, matrix element is preferred over the conventional elements used in the devices of the '349 and '680 references, since they provide for a high percentage of surface to which magnetic components can adhere. Thus, relatively tightly packed matrix elements facilitate separation of magnetics, from the non-magnetics, if means can be provided to ensure controlled release of the magnetics. To facilitate this, release means according to the present invention are provided.

In particular, referring to FIG. 7, in that portion of the arcuate movement indicated between about points 130 and 138, whereat the magnetics are flushed outwardly from the race 100 in the direction of arrow 168, the release means is provided. Specifically, the release means comprises a mechanism by which the matrix element 103 is selectively expanded, decreasing the density of its packing.

Figure 8:
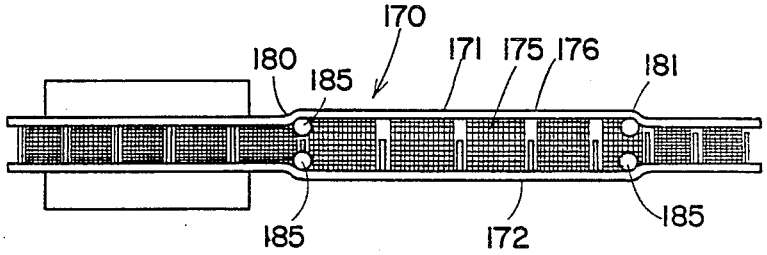
FIG. 8 is a schematic view of an expansion mechanism in a device according to the present invention, shown operating as a release means.

Generally, the release means or mechanism operates by spreading sidewalls of each race apart from one other, in a manner simultaneously expanding the matrix elements therebetween apart. This will be understood by referring to the schematic representation of FIG. 8, as follows:

In FIG. 8, a representative race 170 is depicted, having sidewalls 171 and 172. It will be understood that the race 170 includes matrix element 175 therein. The matrix element 175 is generally as previously described, especially with respect to FIG. 5. It is tightly wedged between sidewalls 171 and 172. The portion 176 of the race 170 from which it is desired to release magnetic material is generally indicated between points 180 and 181, and is referred to herein as the expansion zone. Generally between these points, sidewalls 171 and 172 are deformed or spread apart from one another by cam means as described below. During spreading apart of sidewalls 171 and 172, matrix element 175 also becomes expanded, greatly due to its extension between sidewalls 171 and 172 in a compressed, fluted, manner, FIG. 5. Thus, the matrix element is less densely packed, and backwash from sprayers 137, FIG. 7, will be more effective in washing magnetic material outwardly from the race 100.

A variety of mechanisms may be provided to accomplish the release previously described. For the preferred embodiment, the sidewalls of the races, for example sidewalls 171 and 172, are formed from a flexible material such as a plastic or the like, which can be deformed outwardly but which has substantial elastic memory. Outward deformation is generally accomplished by means of cams such as appropriately positioned rollers 185, FIGS. 7 and 8. Rollers 185 are oriented to be engaged by rotating sidewalls 171 and 172, to spread same apart.

Figure 10:
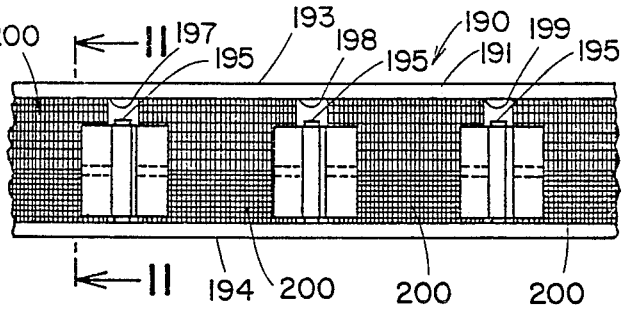
FIG. 10 is an enlarged fragmentary top elevational view, partially schematic, depicting a portion of the apparatus depicted from the general orientation of line 10—10, FIG. 5.
Figure 11:
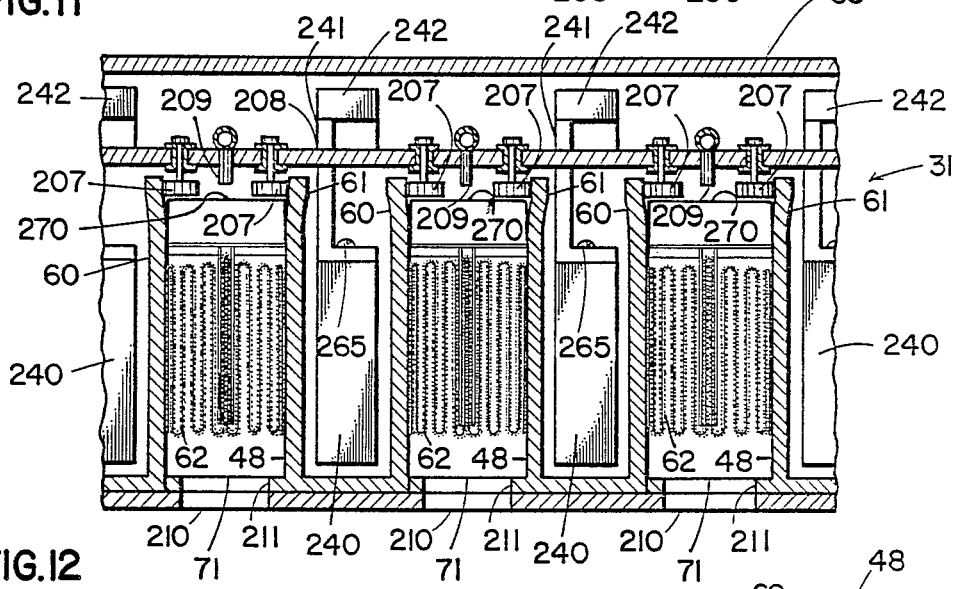
FIG. 11 is an enlarged fragmentary side cross-sectional view, partially schematic, taken generally along line 11—11, FIG. 10.

Operation of the release means or mechanism will be further understood by reference to FIGS. 10 and 11. In FIG. 10 a top view of a portion 190 of a race 191 passing through an expansion zone is depicted. Sidewalls 193 and 194 are shown spread apart. The interior transverse walls 195, corresponding to walls 71, FIG. 6, are attached to sidewall 194 and bend therewith. Gaps between the spread apart wall 193 and the interior walls 195, are indicated at reference numerals 197, 198 and 199.

In FIG. 10 matrix element segments in race 191 are generally indicated at reference numeral 200. Each segment 200 is shown spread apart because it can expand between spread apart opposite walls 193 and 194. Thus, each segment 200 has been spread apart in the directions indicated by double headed arrow 201, due to operation of the expansion or release mechanism.

Further detail concerning this will be understood by reference to FIG. 11. In FIG. 11 a portion of drum 31 having individual races 48 thereon is depicted. Each race includes opposite side walls 60 and 61, having matrix element 62 extending therebetween. It will be understood from examination of FIG. 11, that element 62 is folded as described with respect to FIG. 5, to be compressed accordian-style, or in a fluted manner, between sidewalls 60 and 61.

For the embodiment shown in FIG. 11, the sidewalls 60 and 61 are just beginning to be deformed or spread apart, spreading therewith matrix element 62, segments of which are compressed between sidewalls 60 and 61. Expansion is shown being caused by rollers 207, extending downwardly into race 48, underneath cover 33, from frame 208. Water providing for backwash to flush entrapped magnetic material out of matrix element 62 is provided via sprayers or nozzles 209. The flushed material can drain toward the inside 210 of drum 31, via ports 211. This material would, preferably, be directed into storage bin 142, FIG. 4, via dividers 147 and 148.

In FIG. 11 sidewalls 60 and 61 are just beginning to be spread apart from central dividers or vanes 71, due to action of the release mechanism, specifically rollers 207. It will be recalled that vanes 71 are attached at most to only one sidewall 60. The spacing between rollers 207 may be varied, to cause greater or less deformation. In FIG. 11 very little deformation is shown, whereas in FIG. 10 a substantially greater percentage of deformation is indicated.

There is at least one portion of the rotation path of each matrix segment, in which it is particularly desired to have a tightly compressed matrix element arrangement. This occurs in the immediate vicinity of the outlet port 92, for the feed hopper 91, FIG. 4. That is, as the feed material is first introduced into the race, it is particularly desired to have a tightly packed matrix to facilitate initial setting up of the magnetic material into an entrapped condition. Referring to the schematic of FIG. 7, this is between points 114 and 115. Means facilitating this are illustrated schematically in FIG. 9. This means is helpful, because otherwise the tightly compressed matrix element might tend to spread apart the sidewalls somewhat, just due to expansion forces.

Figure 9:
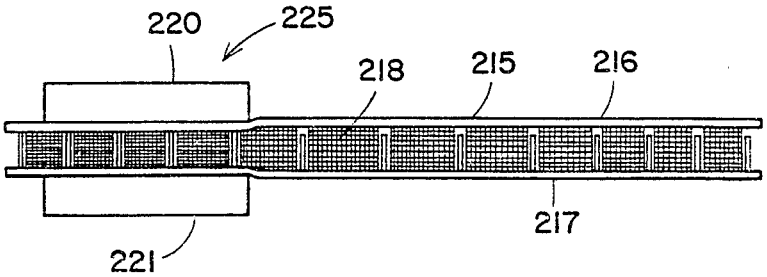
FIG. 9 is a schematic view of a compression mechanism of a device according to the present invention, shown operating to compress portions of the device, selectively.

Referring to FIG. 9, race 215 is depicted having opposite sidewalls 216 and 217, with matrix element 218 extending therebetween. As with release mechanism depicted in FIG. 8, opposite sidewalls 216 and 217 are generally flexible, and thus not only expandable outwardly, FIG. 8, but also can be compressed inwardly, FIG. 9. Compression forces to drive the sidewalls 216 and 217 inwardly are provided by cams 220 and 221 respectively.

Generally, compression mechanism 225 of FIG. 9 facilitates overall device operation, when used in combination with the expansion mechanism of FIG. 8. That is, compression is desirable to counter the effects of expansion, and to enhance operation of the magnetic zone between points 114 and 115, FIG. 7. It will be understood that operation of the overall device may also be facilitated by positioning a second compression zone in the area of the magnetic field defined between points 127 and 130.

A variety of relative amounts of expansion and contraction may be utilized in devices according to the present invention. For a typical system, the normal race width, i.e. normal distance between opposite sidewalls, is about 2 inches. With sufficiently flexible sidewall material, up to about 100% expansion, or expansion out to about a 4 inch separation, is readily achievable and desirable to facilitate a good, quick, release. Slip surfaces between the compression cams and the sidewalls, or the expansion cams and the sidewalls, can be facilitated in a number of manners including through roller engagements, low friction surfaces, and similar means.

From reference to FIGS. 11, 13 and 14, mounting of magnets to generate the desired magnetic field(s) will be understood. Referring to FIG. 11, magnets 240 are shown suspended between races 48, by brackets 241 suspended from arms 242. Preferably, arms 242 are adjustable, FIGS. 11 and 13, such that they can be raised or lowered with respect to the races 48, and drum 31. An adjustability in positioning of the magnets 240 through movement of arms 242 allows for adjustment in the effective strength of the magnetic field applied to the races. For preferred embodiments, each arm 242 includes a plurality of slim magnets 246, FIG. 13, mounted side-by-side in a manner forming a magnetic arc.

While a plurality of arrangements of the magnets may be utilized, preferably, the magnets are aligned as illustrated in FIG. 14, with alternating poles. That is, each magnet 246 has a pole facing each race, with polarity alternating between adjacent magnets. Thus, as the drum 31 and race 48 are rotated through the magnetic arc, each matrix section moves through a plurality of closely spaced, alternating, magnetic fields. This has in general been observed to enhance separation by comparison to conventional fields of a single, non-alternating polarity.

The magnets 240 illustrated in FIG. 11 are depicted in FIG. 13 as occupying the magnetic arc 250, corresponding to the arc between points 127 and 130, FIG. 7. The primary magnetic arc, illustrated at reference numeral 255, FIG. 13, similarly comprises a plurality of alternating magnets mounted upon a bracket system 256. Preferably, again, bracket system 256 is adjustable to allow modification in the strength of the magnetic field, by permitting adjustment of the depth to which the magnets are inserted between the races. Magnetic arc 255 is generally analogous to the magnetic arc illustrated in the schematic of FIG. 7, between points 114 and 115.

It will be understood that any of a variety of mechanical means may be utilized to permit adjustment of arcs 250 and 255. For the embodiment shown, bolt attachments 260, 261 and 262 provide for the adjustment by an adjustable mounting to the frame 32.

Referring to FIGS. 11 and 14, each individual magnet 246 is mounted by means of a bolt 265.

Preferred application of the above described arrangement concerns use in association with an ore-containing slurry. When the slurry is first fed into a race, it is desirable to have relatively little water current tending to pull the solid ore material outwardly from the mesh element, so that the magnetic particles can readily migrate to association with the mesh, under the influence of the applied magnetic field. To accomplish this, cover means are associated with the arrangement of the present invention. This cover means will be understood by reference to FIGS. 11, 12 and 16.

Referring to FIG. 12, each transverse wall 71 includes a flexible flap member 270 mounted along an outer end 271 thereof. Referring to FIG. 11, preferably each flap 270 is sized so that it can clear structures such as nozzles 209, where necessary.

Referring to FIG. 12, in the immediate vicinity of the feed line 81, a cover member 275 is provided in association with each race. Each cover member 275 comprises a strip of material 276, FIG. 16, mounted within a portion of drum cover 33 and oriented to extend in a preferred relationship with the sidewalls 60 and 61 of each race 48. In particular, referring to FIG. 16, strip 276 includes outer walls 277 and 278 and central section 279. Outer walls 277 and 278 engage sidewalls 60 and 61. Central section 279 overlaps the open outer end 280 of the race 48. As each race segment 69 passes by cover, the associated flaps 270 are deflected by cover member 275. The cover member 275 in association with edges 276 and 277, sidewalls 60 and 61, and flaps 270 then generally enclose the outer end of each race 48, inhibiting fluid from flowing outwardly therefrom, in the vicinity of the race 48. In this manner, fluid being fed into the system along line 82, fills up each passing mesh segment, but then turbulence is substantially halted, in the first section of the first magnetic field, i.e. along the arc between points 280 and 281, FIG. 12. During this section of movement, no magnetics or non-magnetics are released from the race 48, but rather the magnetics migrate to the mesh without substantial interference from turbulent current of water flowing through the system. When point 281 is reached, each mesh segment passes beyond the cover member 275, and water is allowed to flow through open area 290, and into trough system 155, FIG. 4.

A variety of means may be utilized to retain the individual segments of the matrix element in position, and to mount flap members 270 in position on the vanes 71. Generally, it is preferred to retain the mesh elements in a rather tightly held manner, but also in a manner which lends itself to ease of removal and replacement. A reason for tight engagement is to prevent slippage of the matrix element relative to the race, which could allow portions of the matrix element to become trapped between the sidewalls and the vanes during expansion and compression. Ease of removal and replacement permits change of damaged matrix elements, ease of unplugging should any major plugging occur, and ease of replacement with matrix elements of different constructions for different ore separations, if desired.

While independent means may be utilized to generate flap mounting and matrix retention, for preferred embodiments of the present invention a single retention means is utilized. In particular, a retaining member or retaining clip system is provided.

Referring to FIG. 18, a retaining clip 300 is depicted. Retaining clip 300 includes a spring clip portion 301, a matrix engaging extension portion 302 a flap portion 303, and a guard 304. When mounted in the device 30, the flap portion 303 operates as a flap member 270. For preferred embodiments, the clip portion 301 comprises a compression or spring type clip slipped over an outer end 271 of a vane 71 for mounting of the retaining clip 300. The extension portion 302 is inserted downwardly into the matrix element, for example between folds, to retain the matrix element in position. Preferably the extension portion 302 is inserted into the matrix element before insertion of the matrix into the recess. The clip may then be used as a handle to remove and replace matrix in the race, as required. The guard 304 operates as a splash guard and helps prevent the matrix segments from falling outwardly from the races.

For preferred embodiments, the retaining clip system includes a second clip member 310, FIG. 17. The second clip member 310 does not include a flap member, but is otherwise similar to clip member 300, that is it has a clip 311, an extension 312, and a guard 314. Referring to FIG. 19, both clip members 300 and 310 are shown mounted in association with one another, as they would be over a single transverse wall. In FIG. 19, a transverse wall 317 is shown in phantom lines with a portion 318 thereon for engagement by indentations 319 on the clip members 300 and 310. The clip members 300 and 310 on adjacent transverse walls cooperate to provide two retaining extensions for each matrix segment, segment, FIG. 12. With clip arrangements such as shown in FIGS. 17, 18 and 19, it may be possible in some embodiments for both race sidewalls to be pulled away from the transverse wall, as the clips may be used to retain the matrix in position.

From the above descriptions, a general method of separating magnetic and non-magnetic fractions in an ore-slurry will be understood as involving the steps of:

(a) using a separator race having an expandable/contractable matrix element therein; the matrix element having an expanded orientation and a contracted orientation;

(b) applying a magnetic field across a selected portion of the race;

(c) providing the matrix element in the selected portion of the race, and within the magnetic field, in the contracted orientation;

(d) feeding an ore-slurry into the selected portion of the race, and (i) allowing magnetic materials to become entrapped within the matrix material; and (ii) permitting non-magnetic materials to be transported outwardly therefrom;

(e) removing the selected portion of the race from the magnetic field; and, (f) expanding the matrix element in the selected portion of the race, once removed from the magnetic field, into the expanded orientation to facilitate release of the magnetic material.

It is to be understood that while certain embodiments of the present invention have been illustrated and described, it is not to be limited to the specific forms or arrangements of parts herein described and shown.

What is claimed and desired to be secured by letters patent is as follows:

1. A magnetic separator device comprising:

(a) at least one race having first and second opposite sidewalls and matrix material positioned therebetween, said race opposite sidewalls being flexible and selectively deformable toward and away from one another;

(b) expansion means selectively expanding at least a portion of said matrix material from a more dense orientation to a less dense orientation;

(c) motive means selectively rotating said race through a 360° arc about a central-axis-of rotation;

(d) ore-slurry feed means for selectively feeding an ore-slurry into said matrix material;

(e) a magnetic zone including a first magnetic field applied across said race during a first selected portion of the 360° arc-of-rotation, to selectively retain magnetic material from the ore-slurry feed in said matrix materials; and (f) a release zone comprising a selected portion of said 360° arc-of-rotation at which no substantial magnetic field is applied across said race.

2. A magnetic separator device according to claim 1 including compression means selectively compressing at least a portion of said matrix material toward said more dense orientation.

3. A magnetic separator device according to claim 1 wherein said matrix material is compressed between said race sidewalls such that said matrix material expands toward said less dense orientation as associated portions of said opposite sidewalls deform away from one another.

4. A magnetic separator device according to claim 3, wherein said expansion means includes a cam mechanism constructed and arranged to selectively deform at least portions of said deformable sidewalls away from one another.

5. A magnetic separator device according to claim 4 including compression means selectively compressing at least a portion of said matrix material toward said more dense orientation.

6. A magnetic separator device according to claim 5 wherein:

(a) said compression means includes a cam mechanism constructed and arranged to selectively deform at least portions of said deformable race sidewalls toward one another.

7. A magnetic separator device comprising:

(a) at least one ring-shaped race having first and second opposite sidewalls and matrix material positioned therebetween;

(i) said race opposite sidewalls being flexible and selectively deformable toward and away from one another;

(ii) said matrix material being compressed between said race sidewalls such that as portions of said opposite sidewalls deform away from one another, associated portions of said matrix material expand toward a less dense orientation;

(b) motive means selectively rotating said ring-shaped race through a 360° arc about a central axis-of-rotation;

(c) ore-slurry feed means selectively feeding an ore-slurry into said matrix material;

(d) a first magnetic zone including a first magnetic field applied across said race during a first selected portion of the 360° arc-of-rotation, to selectively retain magnetic material from an ore-slurry feed in said matrix material;

(e) a release zone comprising a selected portion of said 360° arc-of-rotation at which no substantial magnetic field is applied across said race; and, (f) expansion means selectively expanding a portion of said matrix material in at least a portion of said release zone, by biasing portions of said opposite race sidewalls apart from one another in said portion of said release zone.

8. A magnetic separator device according to claim 7 wherein:

(a) said expansion means includes a cam mechanism constructed and arranged to selectively deform portions of said deformable sidewalls away from one another.

9. A magnetic separator device according to claim 7 including:

(a) compression means selectively compressing portions of said matrix material in at least a portion of said first magnetic zone, by biasing portions of said opposite race sidewalls toward one another in said portion of said first magnetic zone.

10. A magnetic separator device according to claim 9 wherein:

(a) said compression means includes a cam mechanism constructed and arranged to selectively deform at least portions of said deformable race sidewalls toward one another.

11. A magnetic separator device according to claim 10 wherein:

(a) said expansion means includes a cam mechanism constructed and arranged to selectively deform portions of said deformable sidewalls away from one another.

12. A magnetic separator device comprising:

(a) at least one ring-shaped race having: first and second opposite and substantially planar sidewalls; a plurality of spaced transverse walls; and, matrix material extending between said opposite sidewalls;

(i) said race being oriented with said opposite sidewalls in substantially vertical planes;

(ii) said race opposite sidewalls being flexible and selectively deformable toward and away from one another;

(iii) said plurality of transverse walls extending generally between said opposite sidewalls and dividing said race into a plurality of segments; each of said transverse walls being attached to no more than one of said opposite sidewalls; and, (iv) said matrix material being divided into a plurality of matrix segments, one each of which is positioned within a selected, associated, race segment; each matrix segment being compressed between said race sidewalls such that as associated portions of said opposite sidewalls deform away from one another, said segment of matrix material expands toward a less dense orientation;

(b) motive means selectively rotating said ring-shaped race through a 360° arc-of-rotation about a substantially horizontal central axis-of-rotation, in a first direction;

(c) ore-slurry feed means selectively feeding an ore-slurry into said matrix material;

(d) a first magnetic zone including a first magnetic field applied across said race during a first selected portion of said 360° arc-of-rotation, to selectively retain magnetic material from an ore-slurry feed in said matrix material;

(e) a release zone comprising a selected portion of said 360° arc-of-rotation at which no substantial magnetic field is applied across said race; and, (f) expansion means selectively expanding a portion of said matrix material in at least a portion of said release zone, by biasing portions of said opposite race sidewalls apart from one another in said portion of said release zone.

13. A magnetic separator device according to claim 12 including:

(a) at least one retainer clip member mounted on each of said transverse walls and including at least one matrix segment-retaining extension engaging an associated matrix segment to help retain same in a selected position.

14. A magnetic separator device according to claim 12 wherein:

(a) said ore-slurry feed means is constructed and arranged to feed the ore-slurry into said matrix material at a feed position on a path of rotation of said race somewhere along an arc-of-rotation extending between 90° from an uppermost point on said race and in said first direction, and, 180° from said uppermost point, and in said first direction.

15. A magnetic separator device according to claim 14 wherein:

(a) said race includes an inner edge and an outer edge, with said matrix material permitting ore-slurry flow therebetween; and, (b) said feed position is located at said race inner edge.

16. A magnetic separator device according to claim 15 including:

(a) a cover mechanism constructed and arranged to substantially inhibit fluid flow outwardly from said race, along said race outer edge, over a selected arc-of-rotation beginning approximately oppositely across said race from said feed position, and terminating within said first magnetic zone; and, (b) whereby over a selected arc-of-rotation ore-slurry fed into said race at said feed position is substantially inhibited from flowing outwardly therefrom.

17. A magnetic separator device according to claim 16 wherein:

(a) said cover mechanism includes a cover member and a flexible flap system;

(i) said cover member comprising a strip member mounted to cooperate with said race outer edge to inhibit substantial fluid flow outwardly therefrom; and, (ii) said flexible flap system comprises a flap member mounted on each of said transverse walls, to extend between an associated transverse wall and said strip member as said associated transverse wall is rotated past said strip member;

(b) whereby adjacent flap members on adjacent transverse walls generally define a fluid retaining chamber therebetween, in association with said strip member.

18. A magnetic separator device according to claim 17 including:

(a) at least one clip member mounted on each of said transverse walls and including one of said flap members thereon.

19. A magnetic separator device according to claim 18 wherein:

(a) said clip member includes a matrix segment retaining extension thereon oriented to engage an associated matrix segment to help retain same in a selected position.

20. A magnetic separator device according to claim 15 wherein:

(a) said first magnetic zone encompasses therein an arc-of-rotation of said race extending from said feed position to a point of rotation at least about 225° from said uppermost point and in said first direction.

21. A magnetic separator device according to claim 20 wherein:

(a) said release zone comprises a selected portion of said 360° arc-of-rotation oriented somewhere along an arc between a position 270° from said uppermost point and in said first direction, and 90° from said uppermost point and in said first direction;

(b) whereby as said race is rotated, magnetic material may be released therefrom to move outwardly along said inner edge.

22. A magnetic separator device according to claim 21 including:

(a) a second magnetic zone comprising a second magnetic field applied across said race during a second selected portion of said 360° arc of rotation, to selectively retain magnetic material in said matrix material;

(i) said second magnetic zone encompassing an arc-of-rotation extending somewhere along an arc between 270° in said first direction from said uppermost point and 90° from said uppermost point in said first direction; and (ii) said second magnetic zone being oriented along said arc-of-rotation before said release zone.

23. A magnetic separator device according to claim 22 including:

(a) a cover mechanism substantially inhibiting fluid flow outwardly from said race, along said race outer edge, over a selected arc-of-rotation beginning approximately oppositely across said race from said feed position and terminating within said first magnetic zone;

(b) whereby over a selected arc-of-rotation ore-slurry fed into said race at said feed position is inhibited from flowing outwardly therefrom.

24. A magnetic separator device according to claim 23 wherein:

(a) said cover mechanism includes a cover member and a flexible flap system;

(i) said cover member comprising a strip member mounted to cooperate with said race outer edge to inhibit substantial fluid flow outwardly therefrom; and, (ii) said flexible flap system comprises a flap member mounted on each of said transverse walls, to extend between an associated transverse wall and said strip member as said associated transverse wall is rotated past said strip member;

(b) whereby adjacent flap members on adjacent transverse walls generally define a fluid retaining chamber therebetween, in association with said strip member.

25. A magnetic separator device according to claim 12 wherein:

(a) said first magnetic zone includes a plurality of magnetic fields directed across said race, adjacent magnetic fields having opposite polarity.

26. A method of separating magnetic and non-magnetic fractions in an ore-slurry; said method including the steps of:

(a) providing a separator race having an expandable/-contractable matrix element therein; said matrix element having an expanded orientation and a contracted orientation; said matrix element having first and second opposite sidewalls, sand matrix material therebetween; said opposite sidewalls being flexible and deformable;

(b) applying a magnetic field across a selected portion of said race;

(c) providing said matrix element in said selected portion of said race, and within said magnetic field, in said contracted orientation;

(d) feeding an ore-slurry into said selected portion of said race, and: allowing magnetic materials to become entrapped within said matrix material; and, permitting non-magnetic materials to be transported outwardly therefrom;

(e) removing said selected portion of said race from said magnetic field; and (f) expanding said matrix element by deforming said opposite sidewalls in said selected portion of said race into said expanded orientation to facilitate release of magnetic material therefrom.

27. A magnetic separator race comprising first and second opposite sidewalls and matrix material positioned therebetween, wherein said race opposite sidewalls are flexible and selectively deformable toward and away from one another.

28. A magnetic separator device comprising:

(a) at least one race having first and second opposite sidewalls and matrix material positioned therebetween, said race opposite sidewalls being flexible and selectively deformable toward and away from one another;

(b) expansion means selectively expanding at least a portion of said matrix material from a more dense orientation to a less dense orientation, said matrix material being compressed between said race sidewalls such that said matrix material expands toward said less dense orientation as associated portions of said opposite sidewalls deform away from one another; said expansion means including a cam mechanism constructed and arranged to deform at least portions of said deformable sidewalls away from one another;

(c) motive means selectively rotating said race through a 360° arc about a central-axis-of rotation;

(d) ore-slurry feed means selectively feeding an ore-slurry into said matrix material; and (e) means for applying a magnetic field across a selected portion of the race.

29. A magnetic separator device according to claim 28 including compression means selectively compressing at least a portion of said matrix material toward said more dense orientation.

30. A magnetic separator device according to claim 29 wherein said compression means comprises a cam mechanism constructed and arranged to selectively deform at least portions of said deformable race sidewalls toward one another.

* * * * *